US008555575B2

(12) United States Patent
Stein

(10) Patent No.: US 8,555,575 B2
(45) Date of Patent: Oct. 15, 2013

(54) DEVICE CONNECTING ROOF TO WALL

(76) Inventor: Alejandro Stein, Crans-Pres-Celigny (CH)

( * ) Notice: Subject to any disclaimer, the term of this patent is extended or adjusted under 35 U.S.C. 154(b) by 0 days.

(21) Appl. No.: 12/806,532

(22) Filed: Aug. 13, 2010

(65) Prior Publication Data

US 2012/0036802 A1 Feb. 16, 2012

(51) Int. Cl.

| | |
|---|---|
| ***E04B 1/10*** | (2006.01) |
| ***E04B 5/00*** | (2006.01) |
| ***E04B 1/38*** | (2006.01) |

(52) U.S. Cl.

USPC ..... 52/233; 52/262; 52/272; 52/285.1

(58) Field of Classification Search

USPC ..... 52/233, 262, 272, 284, 285.1, 285.3, 52/287.1, 702

See application file for complete search history.

(56) References Cited

U.S. PATENT DOCUMENTS

| | | | | |
|---|---|---|---|---|
| 2,112,247 | A * | 3/1938 | Mcloughlin | 446/116 |
| 4,433,514 | A * | 2/1984 | Henges et al. | 52/94 |
| 4,619,089 | A * | 10/1986 | Stein | 52/233 |
| 5,144,776 | A * | 9/1992 | Hetzel et al. | 52/92.2 |
| 5,230,198 | A * | 7/1993 | Callies | 52/702 |
| 5,274,974 | A * | 1/1994 | Haag | 52/300 |
| 5,282,343 | A * | 2/1994 | Stein | 52/233 |
| 6,085,469 | A * | 7/2000 | Wolfe | 52/71 |
| 6,295,778 | B1 * | 10/2001 | Burt | 52/592.6 |
| 7,412,804 | B1 * | 8/2008 | Bussinger | 52/233 |
| 7,971,410 | B2 * | 7/2011 | Jerke | 52/702 |
| 2003/0024187 | A1 * | 2/2003 | Wilt | 52/233 |
| 2003/0066250 | A1 * | 4/2003 | Moore | 52/93.1 |
| 2006/0150564 | A1 * | 7/2006 | Dufault | 52/702 |
| 2007/0175129 | A1 * | 8/2007 | Nordli | 52/233 |
| 2009/0301012 | A1 * | 12/2009 | Stein | 52/233 |
| 2010/0011686 | A1 * | 1/2010 | Stein | 52/233 |
| 2010/0088979 | A1 * | 4/2010 | Stein | 52/144 |
| 2010/0281799 | A1 * | 11/2010 | Stein | 52/293.1 |
| 2012/0036792 | A1 * | 2/2012 | Stein | 52/11 |

* cited by examiner

*Primary Examiner* — Ryan Kwiecinski
(74) *Attorney, Agent, or Firm* — Donald S. Dowden

(57) ABSTRACT

For use in a building having a roof and a wall each formed of hollow logs, wherein the wall has an uppermost horizontal log, a device is provided for connecting the roof to the wall. The device has a connector for connection to an end of a roof log, a saddle for mounting on the wall log and spreading the roof load over a wide area of the wall log, and a plate for securing the connector to the saddle.

8 Claims, 3 Drawing Sheets

DEVICE CONNECTING ROOF TO WALL

BACKGROUND OF THE INVENTION

1. Field of the Invention

This invention relates to the construction of inexpensive buildings using hollow metal logs (called "metalogs") and more particularly to a novel and highly effective device for connecting an uppermost log of a wall to logs forming the roof.

2. Description of the Prior Art

Buildings of moderate size can be constructed very quickly and inexpensively using hollow metal logs and devices for connecting them at their ends, as disclosed for example in applicant's prior U.S. Pat. Nos. 4,619,089 and 5,282,343, each of which is incorporated herein by reference. These patents disclose connectors that serve well to construct walls. For one-story structures of up to, say, 250 square feet, they are good enough to support the roof.

However, light-gauge metal tubes of a type used for reasons of economy have insufficient structural resistance to support an upper floor with its live weight. Accordingly, in larger buildings using the technology disclosed in the patents mentioned above, beams and trusses are normally used to help support the walls of upper floors and roofs.

The metalogs themselves are easily made to the proper dimensions by conventional machinery at the building site. The reinforcing trusses and beams, however, must be ordered separately, usually from a local or regional supplier, and often the dimensions are off, creating delays and cost overruns. Correcting mismatches of building materials is especially problematic at remote construction sites.

What is needed is a construction technology that minimizes the need to rely on local suppliers, especially, in areas with little infrastructure.

OBJECTS AND SUMMARY OF THE INVENTION

An object of the invention is to remedy the problems of the prior art noted above and in particular to provide a construction device and method that makes the construction company independent of local suppliers, thereby minimizing the risk of construction delays and cost overruns.

Another object of the invention is to eliminate the need for auxiliary supports in larger buildings made of metalogs.

The foregoing and other objects are attained in accordance with the invention. For use in a building having a roof and a wall each formed of hollow logs, wherein the wall has an uppermost horizontal log, a device is provided for connecting the roof to the wall. The device has a connector for connection to an end of a roof log, a saddle for mounting on the wall log and spreading the roof load over a wide area of the wall log, and a plate for securing the connector to the saddle.

In more detail, the invention provides a device for connecting an end of a first hollow log that forms a part of a roof of a building (roof log) to a second hollow log that forms at least a part of the top of a wall of the building (wall log).

The roof is preferably flat for reasons of economy but may have a pitch. The device comprises a connector having first and second substantially parallel upper and lower substantially horizontal faces joined on one side and spaced apart on the opposite side and having, at said opposite side, a structure adapted for connection to an end of the roof log.

The connector faces are respectively formed with upper and lower paired openings. The invention includes a saddle that has an upper inverted U-shaped portion that fits through the paired openings and a lower portion adapted for mounting on the uppermost wall log. An upper plate extends through the inverted U-shaped portion above the upper opening, so that the device locks the roof log to the wall log. In particular, the upper plate prevents an upwardly directed force applied to the roof log or the connector from lifting the connector off the saddle.

In a preferred embodiment of the invention, the inverted U-shaped portion of the saddle comprises first and second dependent legs that are joined at a base at the top of the inverted U-shaped portion and are elsewhere spaced apart from each other. The lower portion of the saddle comprises first and second flanges spaced apart from each other and respectively extending from the first and second dependent legs. The saddle flanges are shaped conformably to the second log (the uppermost wall log) and wrap partway around the second log.

In this embodiment, the second log and the flanges have a matching cylindrical curvature, and tensile means engages the dependent legs of the saddle and the structure that connects to an end of the roof log. This stabilizes the saddle and prevents the weight of the roof from spreading the first dependent leg and the first flange farther apart from the second dependent leg and the second flange. The roof log therefore cannot sag, even in the absence of auxiliary supports such as beams and trusses.

To enable engagement of the tensile means as described above, the first dependent leg and the first flange are formed with a first slit, and the second dependent leg and the second flange are formed with a second slit. The tensile means preferably comprises a lower plate formed with a pair of slits respectively acting jointly with the first and second slits to enable interlocking of the lower plate and the saddle. The tensile means or lower plate also has a third slit that enables engagement with the structure connected to an end of the roof log.

In accordance with the invention, therefore, the logs of the roof can rest, via the device disclosed herein, on the highest logs of the walls, with no need of having supporting beams or trusses fabricated at a local or regional workshop.

The invention is especially useful in emerging economies. For example, using the invention, it will be possible to go to any of India's 740,000 villages taking along (i) the compact log-forming equipment; (ii) coils for forming the hollow metal logs; and (iii) connecting devices for walls and roofs as described herein. As a bonus, the frames for doors and windows of the building serve as "boxes" for transporting the connecting devices to the construction site.

BRIEF DESCRIPTION OF THE DRAWINGS

A better understanding of the objects, features and advantages of the invention can be gained from a consideration of the following detailed description of its preferred embodiments, together with the accompanying drawings, wherein.

DETAILED DESCRIPTION OF THE INVENTION

Figure 1:
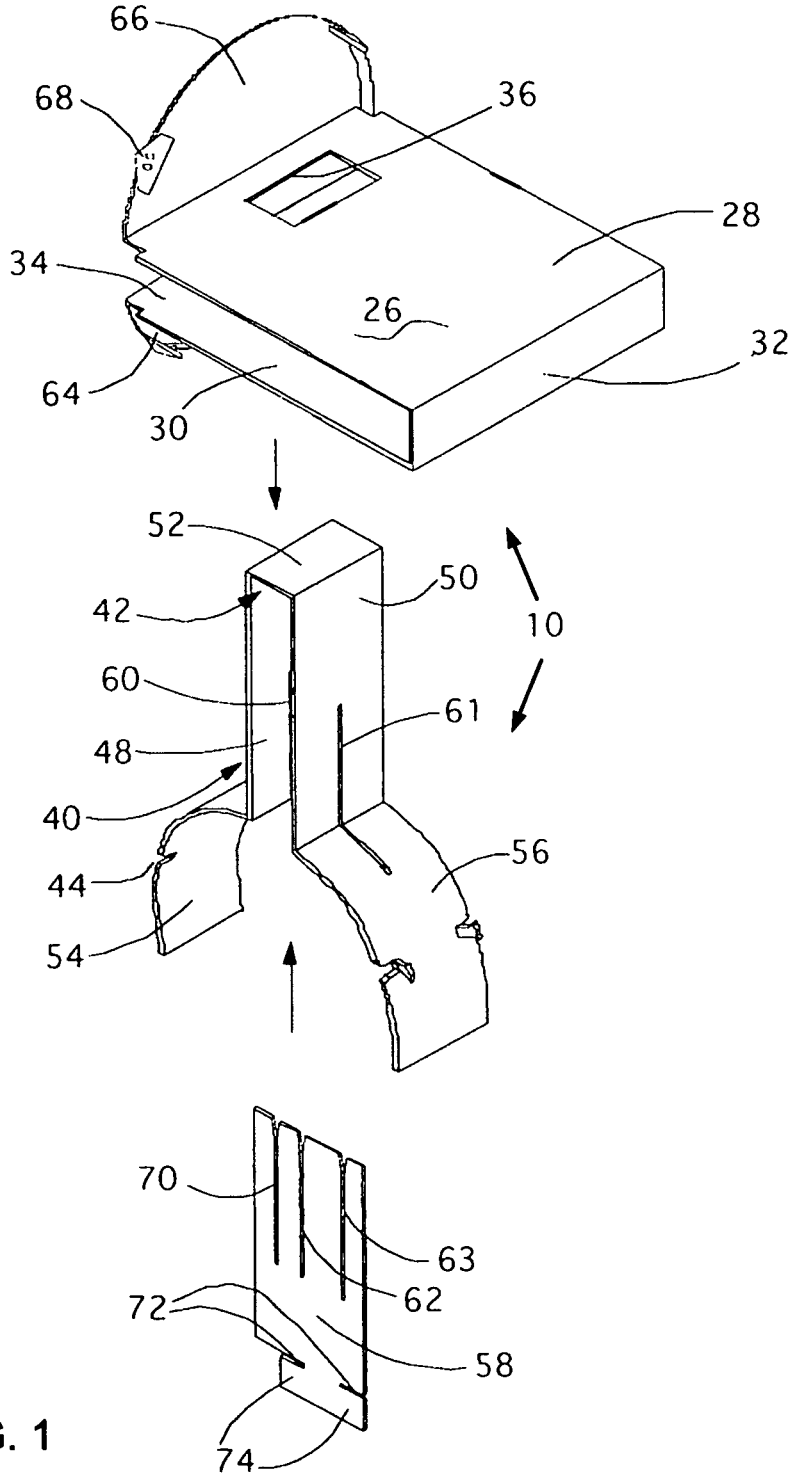
FIG. 1 is a perspective view of certain parts for assembly according to the invention.
Figure 2:
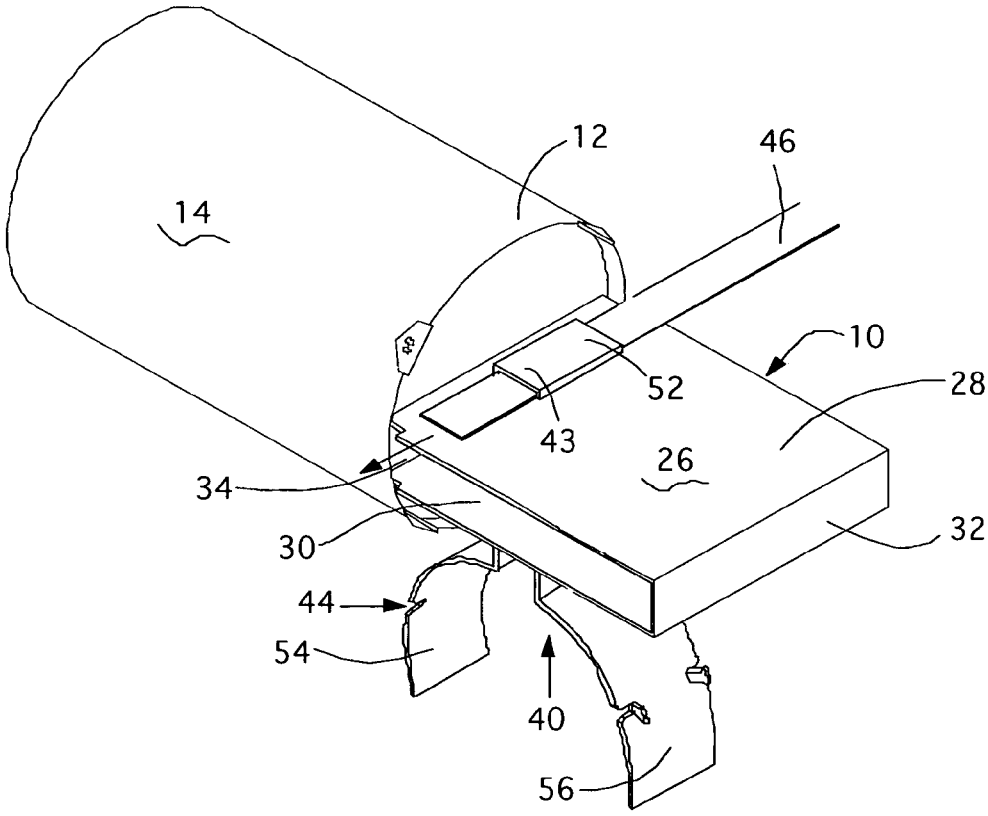
FIG. 2 is a perspective view showing how certain parts are connected in accordance with the invention.

The figures show a device 10 (and a plurality of such devices 10 in the assembly of FIG. 3) for connecting ends 12 of a plurality of first hollow logs 14 that form a roof 16 or part of a roof of a building to a second hollow log 18 that forms at least a part of the top of a wall 20 of the building. The figures show only portions of the roof 16 and wall 20. A wall log 22 lies below the uppermost wall log 18, and other wall logs, not shown, lie below the illustrated log 22.

Similarly, other wall logs 24, including ones not illustrated, lie below the roof logs 14. The logs 18 and 22 and the wall they form are typically at right angles to the logs 24 and the wall they form, though the invention can also accommodate other dihedral angles. If the roof 16 is flat, which is the preferred case for reasons of economical construction, it forms right dihedral angles with all of the walls of the building.

Figure 3:
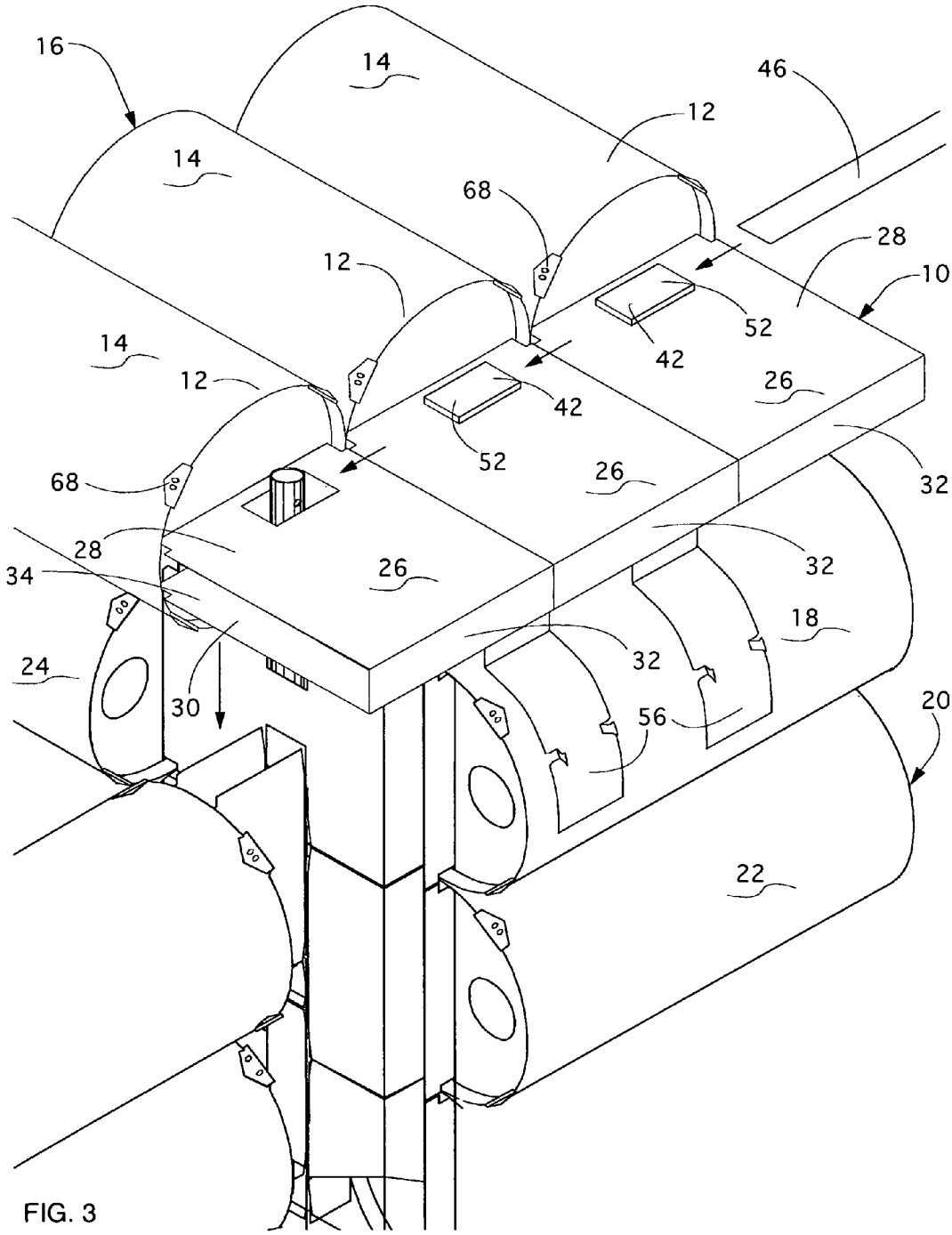
FIG. 3 is a perspective view showing the connection of the uppermost log of a wall to roof logs in accordance with the invention.

Without regard to the optional continuation of the wall 20 shown at the lower left of FIG. 3, that figure can be considered as a representation of a corner of the building from the outside. On the inside, the logs 18 and 22 and the logs below the illustrated log 22, and the logs 24 and the logs below the illustrated logs 24 form two of the inside walls of a room. (Cladding of various types can be superimposed on the inside and outside of the walls, and a waterproofing material is normally added to the roof.)

In accordance with the invention, each device 10 includes a connector 26. It has first and second substantially parallel upper and lower substantially horizontal faces 28, 30 joined on one side 32 and spaced apart on the opposite side 34 and having, at said opposite side 34, a structure adapted for connection to an end 12 of the first hollow log 14.

The substantially parallel upper and lower substantially horizontal faces 28, 30 are respectively formed with upper and lower paired openings 36, the upper one of which is visible in FIG. 1. In accordance with the invention, a saddle 40 is provided having an upper inverted U-shaped portion 42 that fits through said paired openings 36 and a lower portion 44 adapted for mounting on the second or uppermost wall log 18.

A single, unitary upper plate 46 extends through the inverted U-shaped portions 42 above the upper openings 36. It can extend above the upper horizontal face 28 of the leftmost connector 26. In this way, the connectors 26 lock the first or roof logs 14 to the second or uppermost wall log 18.

The inverted U-shaped portion 42 of each saddle 40 comprises first and second dependent legs 48, 50, best shown in FIG. 1, that are joined at a base 52 at the top of the U-shaped portion 42 and are elsewhere spaced apart from each other. The lower portion of the saddle 40 comprises first and second flanges 54, 56 that are spaced apart from each other and respectively extend from the first and second dependent legs 48, 50. The flanges 54, 56 are shaped conformably to the second or uppermost wall log 18 and wrap partway around that log. In the usual case, the log 18 has a cylindrical curvature, and so do the flanges 54, 56.

In the absence of the invention, the ends of the roof logs 14 would bear directly on the uppermost wall log 18 at respective small contact areas. The pressure (force per unit area) at those contact areas would be so great that thin-gauge steel hollow logs would deform, allowing the roof to sag. In conventional practice, therefore, beams or trusses, are necessary.

In contrast, in accordance with the invention, the ends of roof logs do not bear directly on the uppermost wall log. Instead, their weight is distributed over the combined areas of the flanges 54, 56. Because of this weight distribution, the uppermost wall log can carry a heavier roof load without deforming, thereby eliminating the need for auxiliary support by beams and trusses.

Further in accordance with the invention, tensile means 58 engages each saddle 40 and connector 26 to prevent the weight of the roof 16 from spreading the first dependent leg 48 and the first flange 54 that extends from it farther apart from the second dependent leg 50 and the second flange 56 that extends from it.

The tensile means 58 is formed as a plurality of lower plates in a preferred embodiment of the invention. To enable their engagement with each saddle 40 and connector 26, each first dependent leg 48 and first flange 54 is formed with a first slit 60, and each second dependent leg 50 and second flange 56 is formed with a second slit 61 (FIG. 1). Each lower plate or tensile means 58 is formed with slits 62, 63 respectively acting jointly with the first and second slits 60, 61 to enable interlocking of the tensile means or lower plate 58 and the saddle 40.

Each connector 26 has a lower insertion flange 64, partially visible in FIG. 1, which can be substantially a mirror image of the well-illustrated upper insertion flange 66. The insertion flanges 64, 66 are inserted into the ends 12 of the first or roof logs 14. Tabs 68 assist in holding the insertion flanges in position.

Each lower plate or tensile means 58 is formed with a third slit 70 that enables coupling to the respective lower insertion flanges 64. It also has slits 72 that enable bending the bottom of the respective lower plates 58 to form tabs 74 that extend from the respective planes of the lower plates 58 after the lower plates 58 are connected to the respective saddles 40 and lower insertion flanges 64. This prevents the lower plates 58 from slipping backwards through the slits 60, 61 and becoming dislodged from the saddles 40 and lower insertion flanges 64.

It appears from the above that a roof load pressing down on the saddles 40 creates tension in the tensile means or lower plates 58 that prevents the weight of the roof 16 from spreading the first dependent legs 48 and the first flanges 54 farther apart from the second dependent legs 50 and the second flanges 56. This prevents a lowering of the saddle 40 and therefore helps to prevent roof sag.

The device 10 constructed in accordance with the invention is securely connected to both the roof logs 14 and the uppermost wall log 18. In accordance with the invention, therefore, upwardly directed loads due to wind or any other force are effectively resisted by structure including the first or upper plate 46, and downwardly directed loads due to gravity or any other force are effectively resisted by structure including the flanges 54, 56 and the second plates 58.

Given the current state of technology and the current costs of materials and labor in the geographical areas in which the invention confers the most extraordinary advantages, the entire structure disclosed herein, including the device 10 with all of its component parts and the wall logs and roof logs, can be made of a metal such as a thin-gauge steel. It is, however, within the scope of the invention to use plastics and other materials as may be dictated by future technology and the future costs of materials and labor.

Thus there is provided in accordance with the invention a novel and highly effective structure that accomplishes the objects set out above. While a plurality of devices 10 are normally employed, it is within the scope of the invention to employ only one such device. Many modifications of the invention will readily occur to persons having ordinary skill in the art upon consideration of this disclosure. The invention includes all structure methods that fall within the scope of the appended claims.

The invention claimed is:

1. A device for connecting an end of one of a plurality of first hollow logs that form part of a roof of a building to a second hollow log that forms at least a part of a top of a wall of the building, the device comprising:

a connector having substantially parallel upper and lower horizontal faces, said upper and lower horizontal faces joined on one side by a vertical face;

a space formed between said upper and lower horizontal faces by said vertical face, said space forming an open channel between said upper and lower horizontal faces with an opening of said open channel on an opposite side from said vertical face;

a first log connecting structure formed at said opposite side, said first log connecting structure configured to be connected to said end of said one of said plurality of first hollow logs;

said upper and lower horizontal faces further comprising upper and lower paired openings;

a saddle having an upper portion and a lower portion; said upper portion comprises an inverted U-shaped portion that extends through said upper and lower paired openings, said lower portion comprises a second log connecting structure configured to be mounted on said second hollow log;

an upper plate extending through said inverted U-shaped portion above said upper paired opening, whereby said upper plate locks said connector to said saddle, and said device is configured to lock said one of said plurality of first hollow logs to said second hollow log.

2. The device according to claim 1, wherein said inverted U-shaped portion of said saddle comprises first and second vertical dependent legs that are joined at a base of said inverted U-shaped portion and are elsewhere spaced apart;

said second log connecting structure comprises first and second spaced flanges, respectively extending from said first and second vertical legs, said first and second spaced flanges being shaped so to conform with said second hollow log such that the first and second spaced flanges are configured to wrap partway around said second hollow log.

3. The device according to claim 2, wherein said first and second spaced flanges have a cylindrical curvature.

4. The device according to claim 3, further comprising tensile means engaging said saddle to prevent the weight of the roof from spreading said first vertical leg and said first spaced flange from said second vertical leg and said second spaced flange.

5. The device according to claim 4, wherein said first vertical leg and said first spaced flange are formed with a first slit, said second vertical leg and said second spaced flange are formed with a second slit, said tensile means comprises a lower plate formed with multiple slits engaging with said first and second slits to enable interlocking of said lower plate and said saddle so that a roof load pressing down on said saddle creates tension in said lower plate that resists spreading apart of the first and second spaced flanges.

6. The device according to claim 1, wherein said one of said plurality of first hollow logs extends horizontally and the roof is flat.

7. A combination comprising:

a plurality of devices according to claim 1; wherein said upper plate extends through each of said inverted U-shaped portions above each said upper paired opening of each of said plurality of devices to form a single, unitary structure.

8. A method of connecting an end of a first hollow log that forms a part of a roof of a building to a second hollow log that forms at least a part of a top of a wall of the building, the method comprising the steps of:

providing a connector having substantially parallel upper and lower horizontal faces, said upper and lower horizontal faces joined on one side by a vertical face; a space formed between said upper and lower horizontal faces by said vertical face, said space forming an open channel between said upper and lower faces with an opening of said open channel on an opposite side from the vertical face; a first log connecting structure formed at said opposite side, said upper and lower horizontal faces further comprising upper and lower paired openings;

connecting said first log connecting structure to the end of said first hollow log;

providing a saddle comprising an inverted U-shaped portion, said inverted U-shaped portion formed with a base at a closed end and first and second flared flanges forming a second log connecting structure extending from said base at an open end;

extending said closed end of said inverted U-shaped portion through said upper and lower paired openings, mounting said second log connecting structure onto said second hollow log;

extending an upper plate through said inverted U-shaped portion between said base and said upper paired opening locking said connector to said saddle thereby locking said first hollow log to said second hollow log.

* * * * *